US006668612B2

(12) United States Patent
Kruger et al.

(10) Patent No.: US 6,668,612 B2
(45) Date of Patent: Dec. 30, 2003

(54) DEVICE FOR HOLDING A SHEET METAL BLANK IN A FORMING PRESS

(75) Inventors: Gary A. Kruger, Troy, MI (US); Mark G. Konopnicki, Rochester, MI (US)

(73) Assignee: General Motors Corporation, Detroit, MI (US)

( * ) Notice: Subject to any disclaimer, the term of this patent is extended or adjusted under 35 U.S.C. 154(b) by 32 days.

(21) Appl. No.: 10/080,054

(22) Filed: Feb. 21, 2002

(65) Prior Publication Data

US 2003/0154760 A1 Aug. 21, 2003

(51) Int. Cl.[7] ..... B21J 13/10

(52) U.S. Cl. ..... 72/420; 72/313; 72/350; 72/709

(58) Field of Search ..... 72/295, 296, 350, 72/351, 414, 419, 420, 709, 361, 312, 313, 314

(56) References Cited

U.S. PATENT DOCUMENTS 4,211,102 A * 7/1980 Hurvitz ..... 72/304
4,550,585 A * 11/1985 Sasaki ..... 72/351
6,032,504 A * 3/2000 Onat et al. ..... 72/297
6,085,571 A 7/2000 Brinas et al. ..... 72/420
6,354,131 B1 * 3/2002 Pirchl ..... 72/351

FOREIGN PATENT DOCUMENTS

JP 57-64422 * 4/1982 ..... 72/350
JP 2-151322 * 6/1990 ..... 72/350

* cited by examiner

*Primary Examiner*—Ed Tolan
(74) *Attorney, Agent, or Firm*—Kathryn A. Marra

(57) ABSTRACT

A device is provided comprising a guide mechanism used to position and securely hold a sheet metal blank in a sheet metal forming press that is operated at high temperatures. A sheet metal blank is initially positioned in the forming press by resting the sheet metal blank on the highest portion of the convex surface of the lower tool member and counter balancing it with a blank loading device that includes a support hand to initially hold the blank. The guide apparatus comprises an engagement tool mounted to a beam that is slidably attached to guide supports. As the upper tool member drops, the engagement tool pinches and securely holds the sheet metal blank as the guide supports slide along the beam in sync with the downward movement of the upper tool member.

7 Claims, 3 Drawing Sheets

DEVICE FOR HOLDING A SHEET METAL BLANK IN A FORMING PRESS

TECHNICAL FIELD

This invention relates to machines designed to hold sheet metal blanks between upper and lower forming press tools. More specifically, this invention relates to devices designed to secure the sheet metal blank between the forming press tools in connection with superplastic, or other high temperature, forming.

BACKGROUND OF THE INVENTION

Superplastic metallic alloys, such as certain alloys of aluminum, magnesium and titanium, are relatively ductile and can undergo substantial tensile deformation in the presence of low shaping forces. Sheet metal superplastic alloys can be shaped by a variety of processes and can be formed into the complex shapes characteristic, for example, of automotive body panels.

Forming presses have been used to manufacture vehicle body parts using superplastic aluminum alloys, such as very fine-grained AA5083. Often these presses comprise concave upper and convex lower tool members where a sheet metal blank is inserted and initially balanced on the convex lower member. The forming tools have been pre-heated and maintained at a suitable superplastic forming temperature, e.g., 800° F., for the sheet metal blank. The blank itself may have been preheated to this temperature or will simply be heated in the forming press. And since the forming process is gradual and complex, the hot blank needs to be held in proper position between the forming tools.

As the upper concave tool member lowers and closes over the convex lower tool member during press operation, the sheet metal blank must be secured near its edges so that it is properly formed between the tools. Robots can be used to initially place the sheet metal blank on the lower tool in the hot environment. Presently, there exist blank holding devices that temporarily locate the edges or corners of the blank prior to upper tool closure. As disclosed in U.S. Pat. No. 6,085,571 entitled Gravity-Operated Blank Loading Device by Brinas et al., four loading devices, for example, are provided and used inside the press to position the four corners of a rectangular blank between the open tool members. However, these devices release the blank during tool closure. For this reason, there remains a need for a mechanism functional at press operating temperatures to hold the edges of the blank during tool closure for proper part manufacture. Unwanted movement of the blank leads to mal-formed parts and waste.

It is an object of the present invention to provide a blank loading device that is capable of positioning and securing the sheet metal blank to achieve proper alignment in the press that is maintained through out the entire press forming process.

SUMMARY OF THE INVENTION

The present invention provides a device used to position and securely hold a sheet metal blank in a sheet metal forming press operated at high temperatures. The forming press comprises an upper tool member having a concave surface and a lower tool member having a convex surface complementary to that of the upper tool member. The sheet metal blank is initially positioned in the forming press often by resting the sheet metal blank on the highest portion of the convex surface of the lower tool member. The sheet can be balanced, for example, by a gravity operated blank loading device much like that described in the '571 patent. This invention provides a robust mechanism for gripping and securing near the edge of the blank so that it does not move out of position during tool closure.

In accordance with the present invention, sheet metal gripping mechanisms are suitably located at the margin(s) of the upper and lower forming tools. Generally, the forming tools are rectangular in outline and the subject gripping mechanisms would be attached to opposite sides of each tool. Where the inserted blank is balanced on the top of the lower convex tool, the subject gripping mechanisms are preferably located above and below these locations at the sides of the tools. The gripping mechanism carried on the upper tool is positioned to engage the margin of the sheet metal blank as soon as the tool is lowered from its open to its forming position. Preferably, this upper gripping mechanism comprises a block or beam with a knife-edge on its bottom surface. The edge is shaped to progressively engage and deform the sheet metal blank to grip it against a complementary gripping surface on the lower tool underlying the sheet.

As the upper tool lowers, the knife-edge engages the blank but the forming tool continues to drop. The upper knife-edged gripping mechanism must be capable of sliding up the side of the closing upper tool member in order to suitably maintain its grip on the edge of the sheet metal blank. Preferably, the gripping beam or block on the upper tool has sufficient weight or mass so that the knife-edge maintains a tight grip on the edge of the blank as it is undergoing substantial deformation between the working tools. In one embodiment, the gripping beam slides in slotted brackets mounted on the edge of the forming tool. The gripping mechanism comes into contact with the margin of the sheet metal blank and stops. The upper tool continues to lower and the gripping tool slides along its surface as it lowers. The weight of the gripping tool and the friction of the lowering upper tool contribute to the gripping force of the mechanism. Usually there will be at least two or even four such gripping devices attached to the ends of the upper tool member and each gripping device can include one or more knife-edges.

Underlying each of the upper tool gripping mechanisms is a complementary gripping surface located on the lower tool. In a preferred embodiment, each of these lower gripping surfaces remains stationary and are mounted so that they can bear the pressing force of the upper gripping tool and the blank. While the upper surface of the lower gripping device is generally flat like the blank margin that it is engaging, the device may contain a channel underlying the knife-edge of the upper mechanism so that sheet metal can be forced by the knife-edge into the channel to mechanically secure the blank. The channel also prevents the knife-edge from impacting the hard surface of the block, thus prolonging the life of the knife-edge blade. The sides of the channel in the lower gripping surface may be "V" shaped corresponding to the shape of the knife-edge in the upper gripping surface.

An important feature of the invention is the way in which the upper gripping mechanism is supported on the upper forming tool. As described above, it is necessary that the gripping mechanism be capable of sliding up the side of the forming tool as the forming tool closes. In one embodiment, the upper gripping mechanism is carried on a beam that spans the side of the upper tool and slides in slotted vertical brackets. In another embodiment, the upper knife-edged gripping device is carried on a block, which slides on two vertical rods fixed to the side of the upper tool. In still another embodiment, the upper gripping mechanism can be supported by both a rod and a slotted bracket. These features will be described in more detail below.

DESCRIPTION OF PREFERRED EMBODIMENTS

Figure 1A:
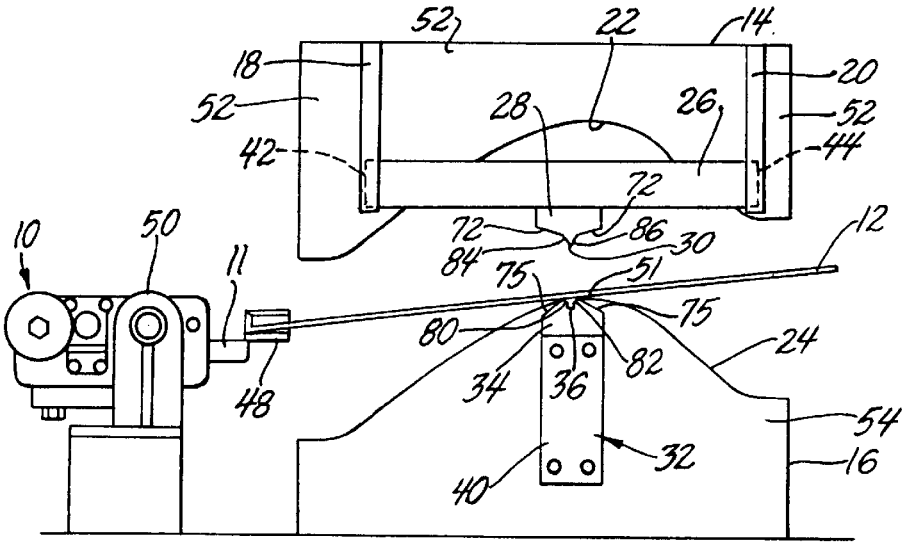
FIGS. 1A–1C show a sequence of side view press forming positions during press operation illustrating a first embodiment of the guide mechanism.

This invention provides an improved design of a gravity operated sheet metal blank loading device comprising a guide mechanism used to securely position a sheet metal blank during high temperature press operation. FIG. 1A provides an end view of a first embodiment of the present invention. A blank loader 10 has a counter-balanced arm 11 with a support hand 48 in which a panel of sheet metal 12 is placed and held. The sheet metal blank 12 is balanced on the highest portion 51 of the convex forming surface 24 of the lower tool member 16 using one or more blank loaders 10. The counter-balanced arm 11 with its pivot 50 can rotate and release the blank 12 during closing movement of the upper tool 14.

The forming press (not shown) includes an upper tool member 14 and a lower tool member 16. The concave surface 22 of the upper tool member 14 comprises a shape suitable for superplastic forming the desired part. The lower tool member 16 includes a convex surface 24, where such surface complements that of the concave surface 22. Surfaces 22, 24 define the shape of the desired part, e.g., body panels, automotive deck lids, tail gates, or the like.

Figure 1B:
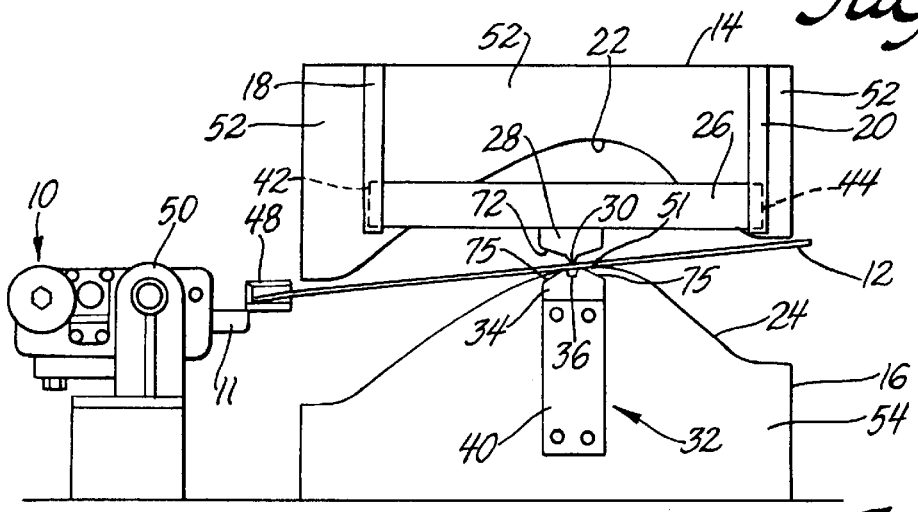
Figure 1C:
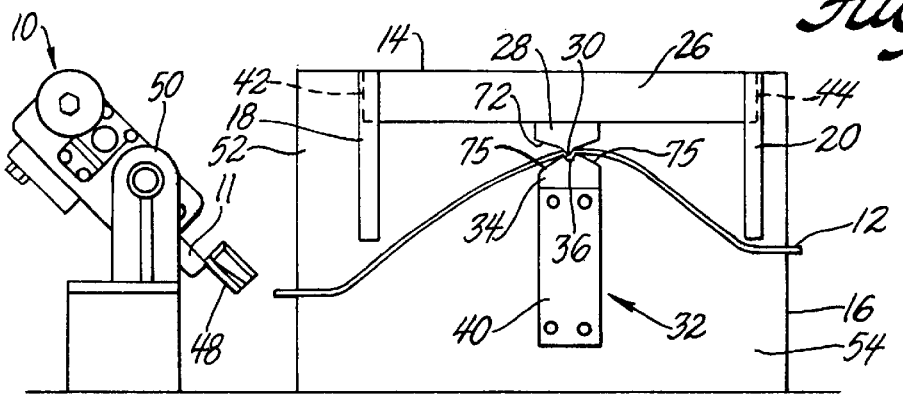
Figure 2:
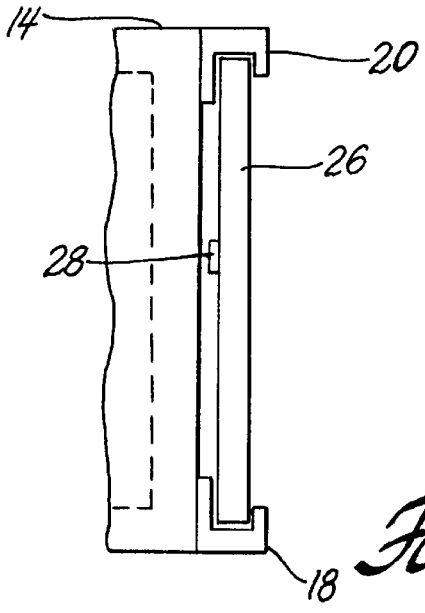
FIG. 2 is a top view of a part of the embodiment shown in FIGS. 1A–1C showing the two slidable brackets and horizontal plate configuration.
Figure 3:
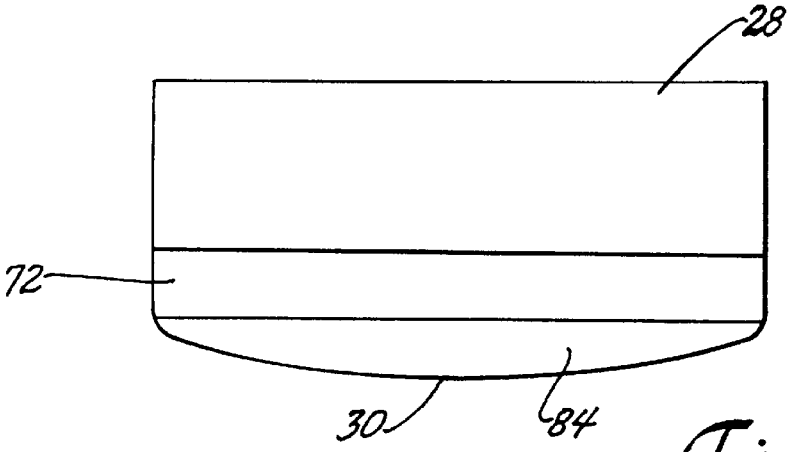
FIG. 3 is a side view of the knife-edged engagement tool used in all three embodiments.

A two-part gripping apparatus is mounted to the ends of the upper and lower forming tools 14, 16 is shown in FIGS. 1A–1C and 2. The upper gripping tool, which is mounted to end surface 52 of upper tool member 14, comprises a horizontal cross-beam 26, where the ends 42, 44 of cross beam 26 are supported in slotted vertical brackets 18, 20. The top view of the brackets 18, 20 is shown in FIG. 4. In the open position of upper tool 14 (FIG. 1A), horizontal beam 26 rests at the bottom ends of brackets 18, 20. Rotational movement of the horizontal beam 26 is restricted by the two brackets. Attached to the center of the bottom of beam 16 is a knife-edge engagement tool 28, for engaging and securing the sheet metal blank 12 between the upper and lower tool members 14, 16. Engagement tool 28 is a metal block with sufficient weight to press on and hold the edge of blank 12. As seen in FIGS. 1A–1C and 3, the bottom portion of tool 28 is tapered at surfaces 72 to a knife-edge 30. For purposes of this description, knife-edge 30 comprises a "V" shape. As best seen in FIG. 3 side surface 84 of knife-edge 30 is curved for more progressive contact of edge 30 with a blank 12. Side surface 86 is similarly shaped.

As seen in FIG. 1A, horizontal beam 26 hangs at the lowest ends of brackets 18, 20. In this open position of upper tool 14, knife-edge 30 is suspended above the margin of the portion of blank 12 lying on the highest point 51 of convex tool surface 24.

Immediately below the same portion of blank 12 is a gripping block 32 with a blank gripping surface member 34 complementary to knife-edge 30 mounted on end surface 54 of lower tool member 16. Gripping surface member 34 has surfaces 75 that slope away from engagement with blank 12. Surface 34 also has a channel 36 underlying knife-edge 30 for good gripping engagement with blank 12. The upper sides 80, 82 of generally rectangular channel 36 taper outwardly and complementary to sides 84, 86 of the upper knife-edge tool.

The shape of surface member 34 allows knife-edge 30 of the tool 28 to press an edge of blank 12 into the sloped sides 80, 82 of channel 36 in secure gripping engagement without piercing or damaging the lower member 16 of the forming press. Surface member 34 is secured to the lower member 16 by means of a support block 40.

FIGS. 1A–1C show a sequence of positions of the high temperature forming tools during operation. The sheet metal blank 10 can be pre-heated before being placed between the forming tools 14, 16. Alternatively, an unheated sheet metal blank 12 can be placed between forming tools 14, 16. The sheet metal blank 12 used in this illustration is made of an aluminum alloy that is heated to a temperature between 800 and 1050° F. for superplastic forming.

Initially, the forming tools are in a press-open position (FIG. 1A). A sheet metal blank 12 is placed and balanced on the highest portion 51 of convex surface 24 of the lower tool member 16. The sheet metal blank 12 is temporarily positioned and held by one or more blank loaders 10. The ends 42, 44 of horizontal beam 26 rests on a pre-formed ledge (not shown) at the bottom ends of brackets 18, 20.

FIG. 1B shows the position of the upper tool 14 as it has moved from its press-open position to an initial engagement position with blank 12. The engagement tool 28 pinches the sheet metal blank 12 at its margin, where it was resting on the lower tool member 16. Once the engagement tool 28 pinches the sheet metal blank 12 against surface member 34, its motion stops as the upper tool member 14 progresses in the downwards direction. As shown in FIG. 2, the space between the brackets 18, 20 and beam 26 permits the closing upper tool 14 to slide past beam 26 and engagement tool 28.

As the upper tool member 14 reaches its press-close position (FIG. 1C), the beam 26 has slid to the top portion of brackets 18, 20, but engagement tool 28 maintains its hold on blank 12. The sheet metal blank 12 has been completely formed and shaped at this point according to the shape of the upper and lower surfaces 22, 24 of tool members 14, 16. As the upper tool member 14 drops, the blank loader 10 releases the blank 12 as the counter-balanced arm 11 tips by means of pivot 50 in conformance with the downward movement of the upper tool member 14 and support hand 48 releases sheet metal blank 12. The lower tool member 14, however, remains stationary during the entire process.

Figure 4A:
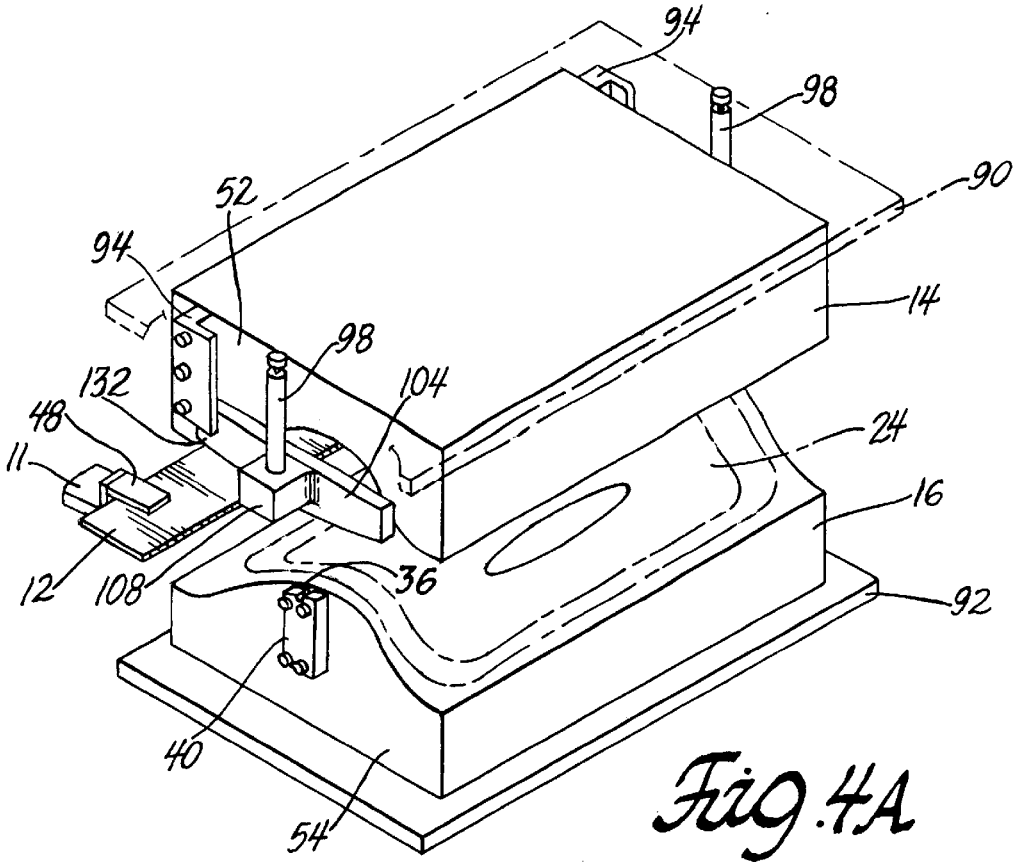
FIGS. 4A and 4B is a perspective view of a second embodiment of the invention showing the positions of the upper and lower tool members of the forming press prior and subsequent to press operation.
Figure 4B:
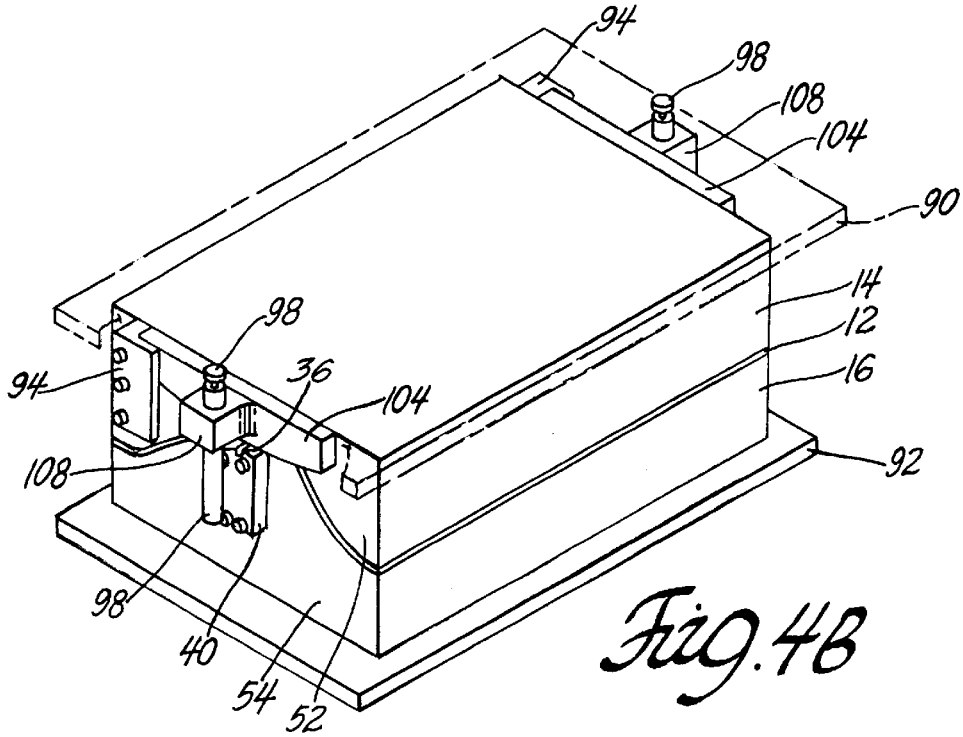

A second embodiment is shown in FIGS. 4A and 4B. FIG. 4A is a perspective view of the forming tools at the press-open position. The top 90 and bottom 92 portions of the forming press carry the upper and lower forming tools 14, 16. A portion of a sheet metal blank 12 is shown held by support hand 48 connected to the counter-balanced arm 11 of the blank loader (not shown) suspended between the open tools 14, 16. The remainder of blank 12 is cut away so that convex surface 24 of the lower tool member 16 can be seen. Surface 24, is shaped to form the desired part.

The gripping apparatus shown in FIGS. 4A and 4B is mounted on the end surfaces 52, 54 of the upper tool member 14 and lower tool member 16, respectively. This gripping apparatus comprises a guide rod 98 held by means (not shown) on the end surface 52 of the upper tool member 14. Engagement block 108 is attached to a horizontal beam 104, which provides additional weight to the apparatus. Block 108 is slidably attached to guide rod 98 and horizontal beam 104 slides in bracket 94. To prevent horizontal beam 104 from twisting or rotating about guide rod 98, the end 132 of the horizontal beam 104 is placed within the slot of bracket 94, which is mounted to the end surface 52 of the upper tool member 14. Thus, the end 132 of the horizontal beam 104 secured from rotation about rod 98 by the bracket 94. The bottom portion of rod 98 provides support (not shown) for the horizontal beam 104 at the press-open stage of the forming process. A knife-edged engagement tool is mounted underneath horizontal beam 104. This knife-edge engagement tool is not visible under horizontal beam 104 in perspective views of FIGS. 4A and 4B. However, this is suitably just like knife-edge engagement tool 28 shown in FIGS. 1A–1C and 3 and described in connection with these figures. A like guide rod 98 and gripping apparatus can also be mounted on the opposite end surface of the upper and lower tool members 14, 16.

As upper tool member 14 drops and approaches the press-close position as shown in FIG. 4B, the knife-edge tool presses the sheet metal 12 (not shown in FIG. 4B) into channel 36. Thus, beam 104 with its knife-edge and block 40 secure sheet metal blank 12 between tool members 14, 16. Once the knife-edge has secured sheet metal blank 12, beam 104 slides upwards guided by bracket 94 and guide rod 98.

Figure 5:
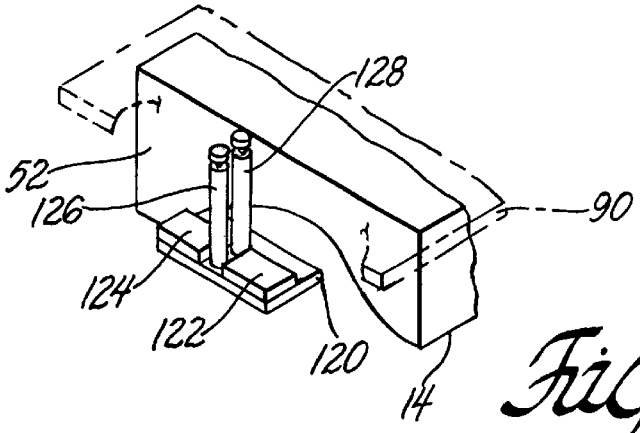
FIG. 5 is a cut-off prospective view of the dual rod configuration of the guide mechanism mounted to the end surface of the upper tool member demonstrating a third embodiment of the present invention.

FIG. 5 provides a cut-off perspective view of the upper tool member 14 and top portion 90 of the forming press of another embodiment of the present invention. The gripping apparatus shown comprises two guide rods 126, 128 connected to an upper block by means (not shown) that is mounted to surface 52 of upper tool member 14. The two guide rods 126, 128 support a horizontal beam 120 such that rotational movement of beam 120 is prevented. The horizontal beam 120 includes two weighted blocks 122, 124. It also carries underlying engagement tool (not shown) on board of guide rod 128. Following the same process as describe above, as upper tool member 14 drops, guide rods 126, 128, slide through horizontal beam 120 and engagement tool knife-edge (not shown) secures and holds a sheet metal blank against a complementary gripping surface.

While the invention has been described in the context of the preferred embodiments, it is not intended to be limited to the above description, but rather only to the extent set forth in the following claims.

What is claimed is:

1. An apparatus for use in positioning and securing a sheet metal blank in a forming press for the forming of sheet metal blanks, said press having a convex lower forming tool and a complementary concave upper forming tool, said upper tool being movable from a press open position for insertion of a sheet metal blank between said tools to a press closed position in which said blank is formed between said upper and lower tools, said tools each having sheet metal forming surfaces, said blank extending over said sheet metal forming surfaces to sides of said tools, said apparatus comprising:

a first sheet metal gripping tool comprising a beam including a knife edge, said beam being slidably supported by at least one guide support mounted on a side of said upper tool;

a second sheet metal gripping tool underlying said knife edge and fixed at a side of said lower tool;

whereby as said upper tool closes toward said sheet metal forming position, said first gripping tool presses said sheet metal blank against said second gripping tool to hold said sheet metal blank in position during forming tool closure and said beam slides with respect to said guide support during said closure.

2. An apparatus as recited in claim 1, where said knife edge is shaped for progressive engagement with said blank during upper tool closure, and said second gripping tool has a gripping surface including a channel underlying said knife edge for receiving and gripping sheet metal deformed by said knife edge.

3. An apparatus as recited in claim 1, wherein said convex lower tool has a metal forming surface crown from a side of said metal forming surface of said tool to an opposing side of its metal forming surface, and said second sheet metal gripping tool is mounted near said crown at each of said sides of said lower tool.

4. An apparatus for securing a sheet metal blank in a forming press, where said forming press comprises a concave upper tool and a complementary convex lower tool, said tools each having sheet metal forming surfaces, said blank being formed between said upper and lower tools as said tools move from a press open to a press closed position, said apparatus comprising:

guide supports mounted to a side of said upper tool member;

a beam slidably attached to said guide supports, wherein said beam comprises a block with a knife edge for engaging said sheet metal blank as said upper forming tool moves to a press closed position; and a load bearing block mounted at said margin of said lower tool for supporting an edge of an overlying sheet metal blank, as said upper forming tool moves to said press closed position, said block having a sheet metal pressing surface comprising a channel underlying said knife edge, said channel having tapered sides for receiving said sheet metal engaged by said knife edge.

5. An apparatus as recited in claim 4, wherein said guide supports comprise a bracket located on an end portion of said beam and a guide rod located centrally of said beam, whereas said knife edge engages said sheet metal blank upon closure of said lower and upper tools, said beam remaining stationary as said guide supports slide downwardly with said upper tool as said upper tool moves to a press closed position.

6. An apparatus as recited in claim 4, wherein said guide supports comprises a bracket located on each end portion of said beam, wherein said knife edge engages said sheet metal blank upon closure of said lower and upper tools, said beam remains stationary as said guide supports slide downwardly with said upper tool as said upper tool moves to a press closed position.

7. An apparatus as recited in claim 4, wherein said guide supports comprises two guide rods to which said beam is slidably supported centrally of said beam, wherein said knife edge engages said sheet metal blank upon closure of said lower and upper tools, said beam remains stationary as said guide supports slide downwardly with said upper tool as said upper tool moves to a press closed position.

* * * * *